US007089875B2

(12) United States Patent
Kurze

(10) Patent No.: US 7,089,875 B2
(45) Date of Patent: Aug. 15, 2006

(54) GLIDING BOARD FOR SPORTS ACTIVITIES ON WATER, SNOW, SAND LAWN AND THE LIKE

(76) Inventor: Ulrich Kurze, Seestrasse 26, Berg (DE) D-82335

( * ) Notice: Subject to any disclaimer, the term of this patent is extended or adjusted under 35 U.S.C. 154(b) by 0 days.

(21) Appl. No.: 10/477,417

(22) PCT Filed: May 10, 2002

(86) PCT No.: PCT/EP02/05193

§ 371 (c)(1),
(2), (4) Date: May 26, 2004

(87) PCT Pub. No.: WO02/089930

PCT Pub. Date: Nov. 14, 2002

(65) Prior Publication Data

US 2004/0231578 A1 Nov. 25, 2004

(30) Foreign Application Priority Data

May 9, 2001 (DE) ..... 101 22 515
May 10, 2001 (DE) ..... 101 22 781

(51) Int. Cl.
*B63B 35/73* (2006.01)

(52) U.S. Cl. ..... 114/55.56; 180/181

(58) Field of Classification Search ..... 114/55.5, 114/55.56, 55.58, 144 A, 315; 180/180, 180/181; 440/37, 62, 7; 441/65
See application file for complete search history.

(56) References Cited

U.S. PATENT DOCUMENTS 3,084,654 A * 4/1963 Rosemberg et al. ..... 114/315
3,144,849 A * 8/1964 Maser ..... 114/55.51
3,150,632 A * 9/1964 Evans ..... 114/55.54
3,334,339 A * 8/1967 McCauley, Jr. ..... 340/870.09
3,548,778 A 12/1970 Romanoff
3,693,577 A * 9/1972 Sade ..... 114/55.56
3,882,815 A 5/1975 Bennett
3,980,039 A * 9/1976 Henning ..... 440/6
4,020,782 A 5/1977 Gleason
4,166,462 A * 9/1979 Ellis ..... 128/202.14
4,614,900 A * 9/1986 Young ..... 318/16
4,748,300 A * 5/1988 Anderson ..... 200/84 C
4,850,907 A * 7/1989 Mula ..... 440/23
4,984,648 A 1/1991 Strzok
5,372,527 A * 12/1994 Flores Cardona ..... 440/44
5,433,164 A * 7/1995 Sneath ..... 114/315
5,582,529 A 12/1996 Montgomery
5,606,930 A 3/1997 LeBlanc et al.

FOREIGN PATENT DOCUMENTS

DE 76 34 723 U 3/1977

(Continued)

*Primary Examiner*—Sherman Basinger
(74) *Attorney, Agent, or Firm*—Moore and Van Allen PLLC; Michael C. Johnston; Jennifer L. Skord

(57) ABSTRACT

The invention relates to a gliding board for sports activities on water, snow, sand, lawn and the like, comprising a body resembling a board, which is equipped with a drive motor, wherein a self-supporting tank for the drive motor covering a large surface of the structure of the board body is integrated in the front part of the board body and wherein the drive motor is movably arranged in and integrated into the back part of the body of the board to change the moving direction of the gliding board.

14 Claims, 1 Drawing Sheet

FOREIGN PATENT DOCUMENTS

| | | | |
|---|---|---|---|
| DE | 26 52 129 | C2 | 5/1978 |
| DE | 82 20 532.9 | U1 | 2/1983 |
| DE | 84 01 738.4 | US1 | 5/1984 |
| DE | 35 03 046 | A1 | 8/1986 |
| DE | 41 00 890 | A1 | 7/1992 |
| DE | 296 12 122 | * | 12/1996 |
| DE | 299 19545 | U1 | 2/2000 |
| FR | 2 430 327 | | 2/1980 |
| FR | 2 644 133 | | 9/1990 |
| FR | 2 688 701 | A1 | 9/1993 |
| FR | 2 766 154 | A1 | 1/1999 |

* cited by examiner

GLIDING BOARD FOR SPORTS ACTIVITIES ON WATER, SNOW, SAND LAWN AND THE LIKE

The present invention relates to a gliding board for sports activities on water, on snow, on natural lawn and artificial lawn, sand and the like.

Such gliding boards are known as sail-less surfboards for surf-riding, as snowboards on snow and as so-called wake boards and serve to cause a movement relative to the medium therebelow, with the sportsman standing on it utilizing the water waves or snow, grass and sand slopes. What must be regarded to be a disadvantage of these devices is the fact that such gliding movements are limited in terms of their duration, either because the water wave runs ashore and ends or because the slope or dune inclinations end in the bottom of a valley.

The present invention is now intended to provide a gliding board of a kind similar to a surfing or snowboard that permits also a longer motion even on flat media.

According to the present invention, hence a gliding board is expediently provided wherein a board-like board body is provided on which the athlete stands like on a surfboard or a snowboard, possible using loops or straps. The propulsion is generated by means of a drive motor that produces either a driving jet or a driving rotating movement for a propeller or wheels or chains. This drive motor has a flat design and is disposed in the rear part of the board body; in accordance with the invention, it is supported for movement so that the direction of movement of the gliding board can be changed.

A rotating means, preferably in the form of a turntable with rotational stops is provided for the mobile support of the drive motor that is integrated into the board body. According to an alternative, the drive motor may also be adapted for being shifted into the board body, also via predetermined paths of movement, in particular along at least one control cam, while it may move on rollers or slides, respectively. This mobility of the drive motor is expediently supported or induced by a change of the direction of movement of the gliding board, which is caused by the person standing on the gliding board.

The envisaged tank is preferably made of a synthetic material and contains carbon fibres. As a result, it can be shaped extremely easily with a high strength in a form that acts as structural element of the gliding board. The tank can be accommodated in an extraordinarily flat form or with a wide area in the board body in such a way that the thickness of the board body can be kept as small as possible and that the tank cannot be recognised from the outside, with the exception of a tank inlet and an optical or acoustical liquid-level indicator.

According to a further embodiment of the invention, a remote controller is provided for the drive motor, preferably a wireless control system (Blue tooth element) that consists preferably of a hand-held part with starter button, speed adjustment and a hand strap.

For driving, a drive motor of flat design is provided as an essential novelty, which is integrated, as far as this is possible, into the rear part of the board body. This drive motor is preferably designed as a compressed-air motor, with the tank being a compressed-air reservoir. This compressed-air motor presents the advantages that it has an extraordinarily low weight and an extremely small configuration and that its operation is extremely compatible in ecologic terms. It comprises at least two pistons in opposition, like a boxer engine, and in operation of the drive motor, which may also be referred to as compressed-air engine, a piston aspirates air and compresses it in a spherical chamber of a volume of 32 $cm^3$, for instance, to a pressure of roughly 20 bar at 400° C. When cold compressed air of 40 bar, for example, is now injected from the tank into this spherical chamber an abrupt expansion of the air takes place, which expands then in a second piston and presses the latter towards a crankshaft. The air is subsequently passed via an exhaust pipe to the outside while the first piston causes already compression in the first chamber again, thus repeating the cycle. The driving force is then transmitted from the simultaneously rotating crankshaft to an enclosed driving propeller provided either on the bottom side or in a recess in the underside of the board body. As an alternative, the rotational driving force may also act on driving wheels, rollers, chains, or similar elements.

In the following, one embodiment of the invention will be explained in more details with reference to the attached drawing wherein.

Figure 1:
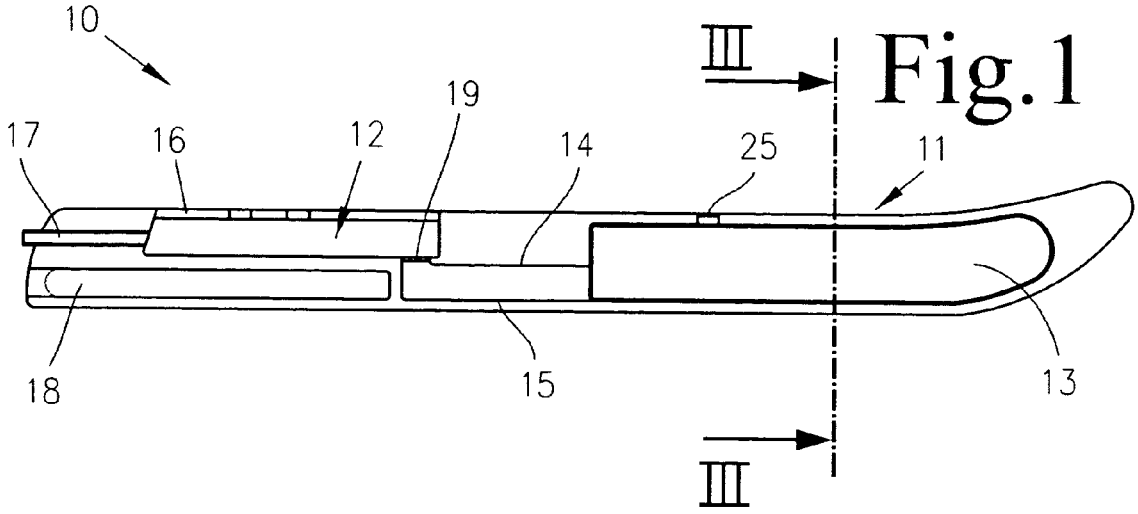
FIG. 1 is a schematic longitudinal sectional view taken through a gliding board according to the invention.

FIG. 1 is a schematic sectional view taken through an embodiment of a gliding board 10. The gliding board 10 comprises a board-like board body 11 that is provided with a drive motor 12. A tank 13 for the drive motor 12 is integrated into the front part of the board body 11, which contributes to the support of the body structure over a wide area and which is connected via flexible movable pipes 14, 15 to the drive motor 12.

In this embodiment, the drive motor is configured as a compressed-air motor whilst the tank 13 is a compressed-air reservoir that is capable of supplying the drive motor 12 in a controlled manner with air, for example, at a pressure of 40 bar.

The drive motor is movably supported in and integrated into the rear part of the board body 11 for a change of the direction of movement of the gliding board 10. In the illustrated embodiment, a schematically roughly indicated turntable 16 is provided as means for shifting the drive motor 12, which turntable is connected to the drive motor 12, with the pipes 14 and 15 being elastic tubes of a sufficient length so as to be able to follow the rotational movements of the turntable up to a predetermined stop. The turntable 16 may also be designed without connection to the drive motor 12. It is inserted into the surface of the board or gliding board 10, respectively, to be flush with the surface, and presents a smooth surface. It enables the user to change the direction (from the windward side to the lee side=180°), with the user standing in the width-wise direction with and without foot straps.

The reference numeral 17 roughly indicates an exhaust pipe whereas the region 18 is provided for driving means not illustrated here, driven by the drive motor 12 and serving to propel the gliding board on the respective medium.

Figure 3:
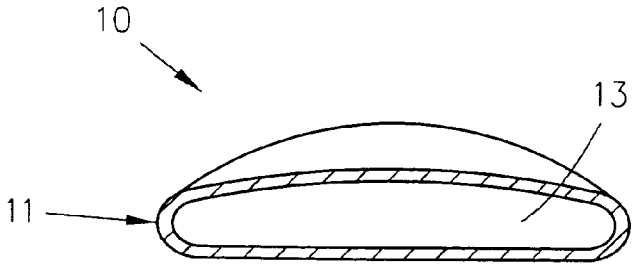
FIG. 3 illustrates a sectional view taken along the line III—III in FIG. 1.

As is shown in FIG. 3, the tank is integrated as large-area structural element into the front part of the board body 11, which contributes to the support the structure. Due to the light charge weight, it is designed as additional support, relative to the lifting force, and ensures the tilting stability of the gliding board 10 over its extension in the width direction. The wall of the tank is formed integrally with the wall of the board body 11. The tank 13 may additionally comprise perforated transverse and longitudinal braces, in a manner not illustrated here, for further enhancement of the stability, with the perforation in the stabilisers serving to make the charge in the tank fully available. The tank 13 may also be designed to have different wall thicknesses, for example on the left and the right edge of the gliding board 10. The tank 13 consists preferably of synthetic material or aluminium.

Figure 2:
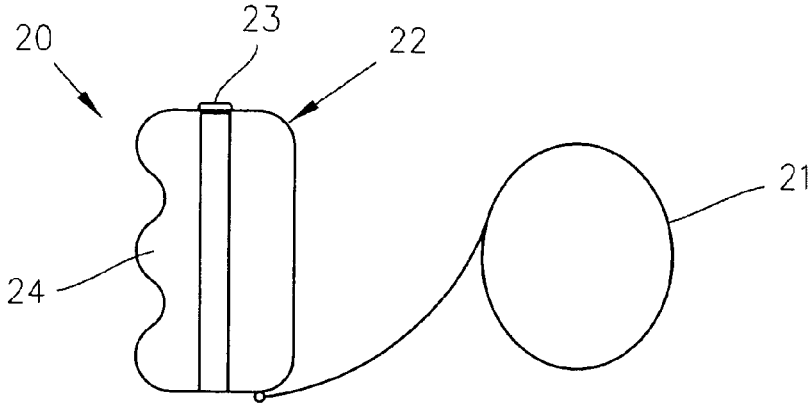
FIG. 2 shows a schematic illustration of a remote controller for controlling the drive system.

FIG. 2 shows an embodiment of a wireless control system 20 (Bluetooth component) in which a hand strap 21 is connected to a hand-held piece 22. The hand-held piece 22 is provided with a starter button 23 on the upper side and with a speed control means 24 that respond to compression of the hand-held piece 22. The control commands are communicated via the Bluetooth component—or, in an alternative embodiment with cable-bound remote controller, via a cable—to the drive motor 12. To this end, the connection with the hand strap 21 may be provided as antenna or Bluetooth component, respectively, or an additional antenna may be provided whilst a receiver is provided in the region of the motor 12 for receiving the radio signals of the hand-held piece 22, which converts the control signals into appropriate motor control information by means of actuators not illustrated here.

The novel gliding board is extraordinarily flexible in terms of the shape in which it may be formed, is of an extremely light weight due to the tank containing nothing but air and on account of the envisaged compressed-air drive system, and can be designed and handled in a reliable and safe manner, with provisions being made for simple checking of the liquid-level in the tank 13 by means of a liquid-level indicator roughly indicated by the reference numeral 25.

The hand-held piece 22 can moreover be designed in such a way that the speed control means 24 automatically switches the drive motor off when the compressed hand-held piece is released, so that not only an extraordinarily high safety and reliability in operation but also economy in consumption of the tank charge can be achieved.

The invention claimed is:

1. Gliding board for sports activities on water, snow, sand, or lawn, the gliding board comprising:

a board-like board body including an upper major surface, a lower major surface, and an edge surface extending between and interconnecting the upper and lower major surfaces, wherein at least a portion of the upper major surface is substantially planar and is sized to accommodate a user standing transversely to the longitudinal axis of the board body;

a drive motor integrated into and movably supported in a rear part of said board body for changing the direction of movement of the gliding board; and a reservoir tank internally integrated into a front part of said board body as a structural element thereof, the tank being operatively connected to the drive motor for supplying the drive motor a fuel, and wherein the gliding board is free of means mounted on the gliding board for the user to maintain the user's balance.

2. Gliding board according to claim 1, wherein said drive motor is disposed in said board body via a turntable for rotating said drive motor relative to said board body in order to change the direction of movement of the gliding board.

3. Gliding board according to claim 1, wherein said drive motor is adapted to be shifted along at least one predetermined path of movement relative to said board body for changing the direction of movement of the gliding board.

4. Gliding board according to claim 1, wherein said tank is made of synthetic resin and contains carbon fibers.

5. Gliding board according to claim 1, wherein said tank comprises a liquid-level indicator.

6. Gliding board according to claim 5, wherein said liquid-level indicator operates in an optical mode.

7. Gliding board according to claim 5, wherein said liquid-level indicator operates in an acoustical mode.

8. Gliding board according to claim 1, wherein a remote controller is provided for said drive motor.

9. Gliding board according to claim 8, wherein said remote controller comprises a hand-held piece including a starter button means for controlling speed of said drive motor.

10. Gliding board according to claim 8, wherein said remote controller comprises a wireless controller.

11. Gliding board according to claim 10, wherein said wireless controller comprises a Bluetooth element.

12. Gliding board according to claim 1, wherein said drive motor comprises a compressed-air motor, and wherein said tank comprises a compressed-air reservoir.

13. Gliding board for sports activities on water, snow, sand, or lawn the gliding board comprising:

a board-like board body comprising an upper major surface, a lower major surface, and a edge surface extending between and interconnecting the upper and lower major surfaces, wherein at least a portion of the upper major surface is substantially planar and is sized to accommodate a user standing transversely to the longitudinal axis of the board body;

a compressed-air reservoir; and a compressed-air motor operatively connected to the compressed-air reservoir; said compressed air motor being integrated into and movably supported in a rear part of said board body for changing the direction of movement of the gliding board, wherein the compressed-air reservoir is internally integrated into the structure of said board body as a structural element thereof, and wherein the gliding board is free of means mounted on the gliding board for the user to maintain the user's balance.

14. Gliding board according to claim 13, wherein compressed-air reservoir is integrated into the front part of said board body.

* * * * *